US006443526B1

(12) United States Patent
Scarlett

(10) Patent No.: US 6,443,526 B1
(45) Date of Patent: Sep. 3, 2002

(54) LUBRICATION OF OSCILLATING HEAD ELEMENTS FOR FLOOR STRIPPING MACHINES AND METHOD OF USING THE SAME

(76) Inventor: Lee A. Scarlett, 615 N. 3050 East, Suite A5, St. George, UT (US) 84790

( * ) Notice: Subject to any disclaimer, the term of this patent is extended or adjusted under 35 U.S.C. 154(b) by 0 days.

(21) Appl. No.: 09/945,520

(22) Filed: Sep. 4, 2001

Related U.S. Application Data

(63) Continuation of application No. 09/411,001, filed on Oct. 9, 1999, now abandoned.

(51) Int. Cl.[7] ..... A47L 13/02
(52) U.S. Cl. ..... 299/37.1; 299/36.1
(58) Field of Search ..... 299/36.1, 37.1; 384/292

(56) References Cited

U.S. PATENT DOCUMENTS

| | | | | |
|---|---|---|---|---|
| 2,430,752 A | * | 11/1947 | Yager | 384/144 |
| 3,179,196 A | | 4/1965 | Richardson | |
| 3,214,363 A | | 10/1965 | Amori | |
| 3,376,071 A | | 4/1968 | Stein | |
| 3,770,322 A | | 11/1973 | Cobb et al. | |
| 4,230,332 A | | 10/1980 | Porsche | |
| 4,365,842 A | | 12/1982 | Grasse | |
| 4,365,843 A | | 12/1982 | Grasse | |
| 4,452,492 A | | 6/1984 | Grasse | |
| 4,483,566 A | | 11/1984 | Grasse | |
| 4,504,093 A | | 3/1985 | Grasse | |
| 4,512,611 A | | 4/1985 | Grasse | |
| 4,669,784 A | * | 6/1987 | Grasse | 299/37.1 |

* cited by examiner

*Primary Examiner*—David Bagnell
*Assistant Examiner*—Sunil Singh
(74) *Attorney, Agent, or Firm*—William W. Haefliger

(57) ABSTRACT

Apparatus usable in power-operated floor stripping apparatus that includes a frame, a drive carried on the frame, wheels supporting the frame, a handle to guide the frame, and a cutting blade carried by a head which is pivotally mounted to the frame, the apparatus comprising a lightweight rugged connecting element having a first tubular part and a second tubular part, those parts having spaced, parallel axis, the second tubular part pivotally connected to the head. There are two axially spaced eccentrics on the drive shaft, which rotate within two annular bearings carried by the first tubular part. Spiral grooves are sunk in the external surfaces of said eccentrics to communicate with said lubricant receiving space to receive lubricant for distribution along said eccentrics to the annular bearings.

13 Claims, 8 Drawing Sheets

FIG. 13.
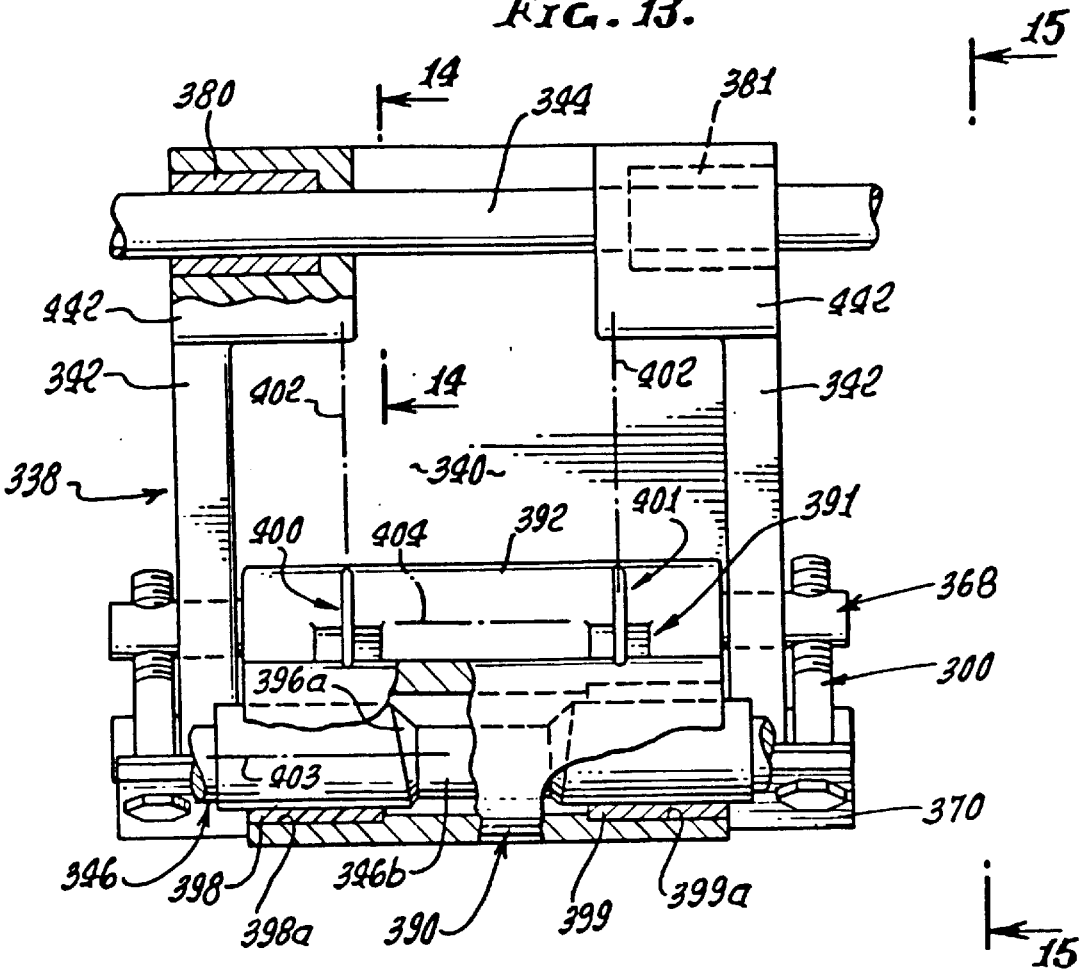
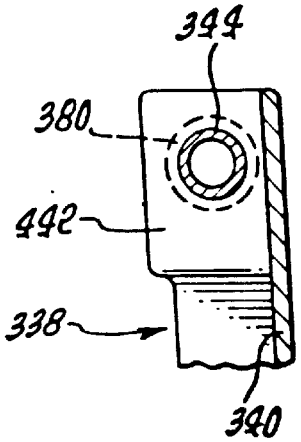
FIG. 14.

LUBRICATION OF OSCILLATING HEAD ELEMENTS FOR FLOOR STRIPPING MACHINES AND METHOD OF USING THE SAME

This application is a continuation of Ser. No. 09/411,001, filed Oct. 1, 1999, now abandoned.

BACKGROUND OF THE INVENTION

This invention relates generally to floor stripping devices, and more particularly concerns improvements in the driving and blade support means for same.

U.S. Pat. No. 3,376,071 discloses a floor stripping machine of the type in which the present invention is usable to great advantage. Such machine incorporates a cutting blade carried by a head pivotally mounted to a frame. Problems with machines as disclosed in that patent include failure of rapidly oscillating head driving connecting rods and associated parts and bearings; insufficient lubricating of such rods, parts and bearings, undue wear of the oscillating head at its pivots; unwarranted high cost of repair and replacement of such elements; and difficulty with clamping a blade to the bottom side of the head.

U.S. Pat. Nos. 4,512,611, 4,504,093, 4,483,566, 4,452,492, 4,365,843 and 4,365,842 and 4,512,611 disclose improvements over said U.S. Pat. No. 3,376,071.

SUMMARY OF THE INVENTION

It is a major object of the invention to provide an additional solution to the above described problems and disadvantages. Basically, the invention is embodied in improved floor stripping apparatus having a floor stripping blade, a head, and a drive, and includes:

a) a connecting element having a first tubular part and a second tubular part, said parts having spaced, parallel axes, said second tubular part pivotally connected to the head, b) a drive shaft extending within the first tubular part, said shaft operatively connectible to the drive to be rotated thereby, c) said drive shaft carrying two axially spaced eccentrics to be rotated by the shaft, there being a lubricant receiving space located directly between said eccentrics, d) two annular bearings respectively carried by and within said first tubular part, said bearings respectively receiving said spaced eccentrics to oscillate said first tubular part, said head and said blade as said eccentrics are rotated by the shaft.

e) there being spiral grooves sunk in the external surfaces of said eccentrics to communicate with said lubricant receiving space to receive lubricant for distribution along said eccentrics to the annular bearings.

These and other objects and advantages of the invention, as well as the details of an illustrative embodiment, will be more fully understood from the following specification and drawings, in which:

DRAWING DESCRIPTION

FIG. 13 is an elevation showing details of an improved version;

Figure 15:
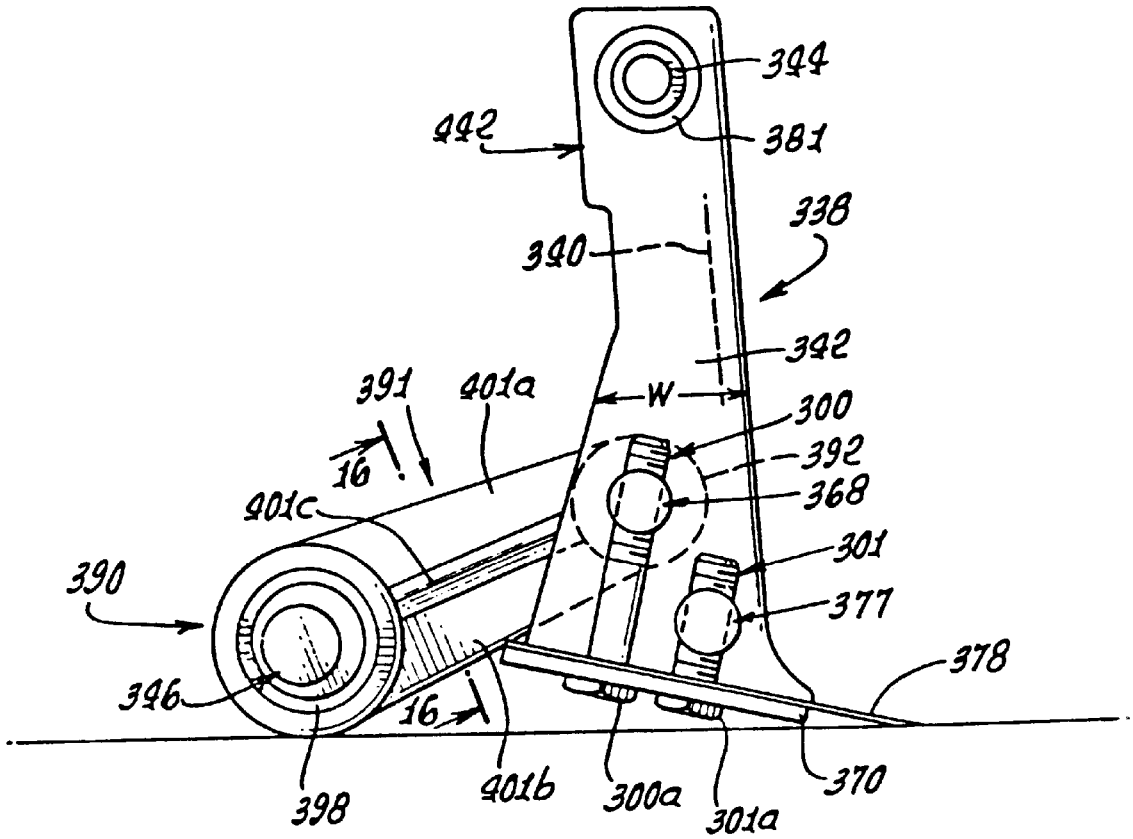
Figure 16:
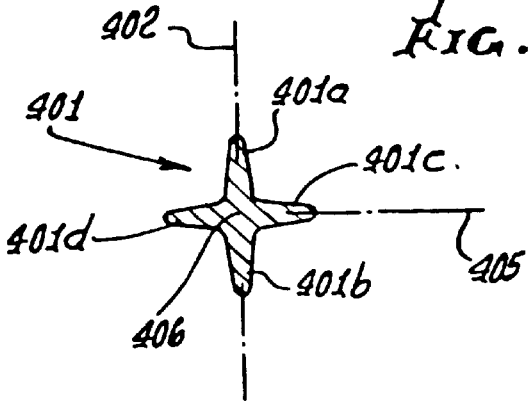
Figure 17:
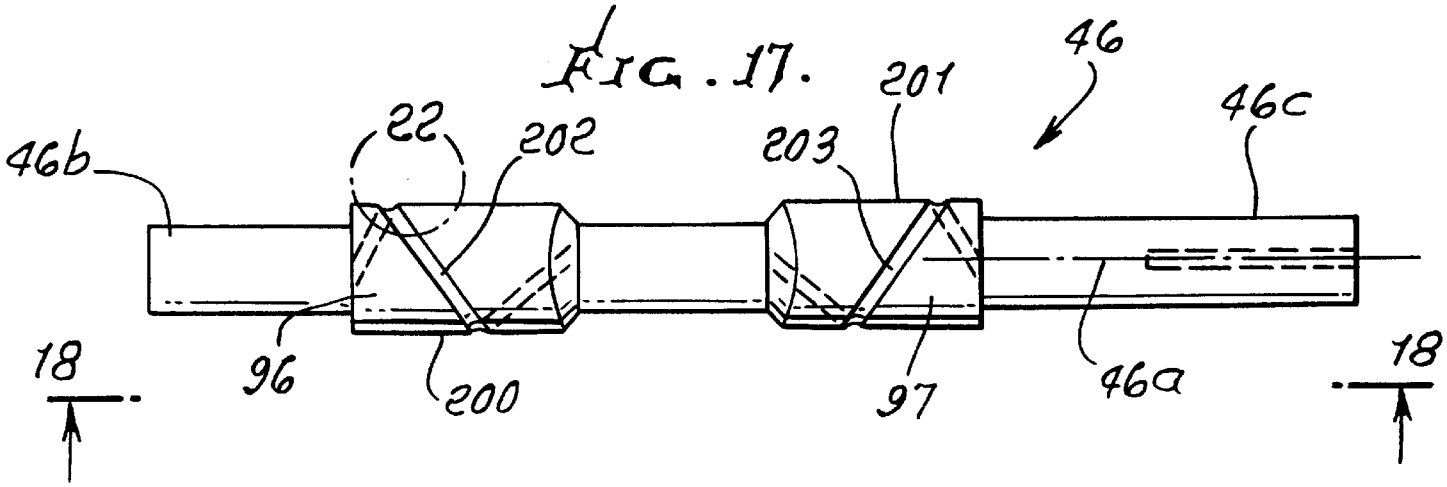
Figure 18:
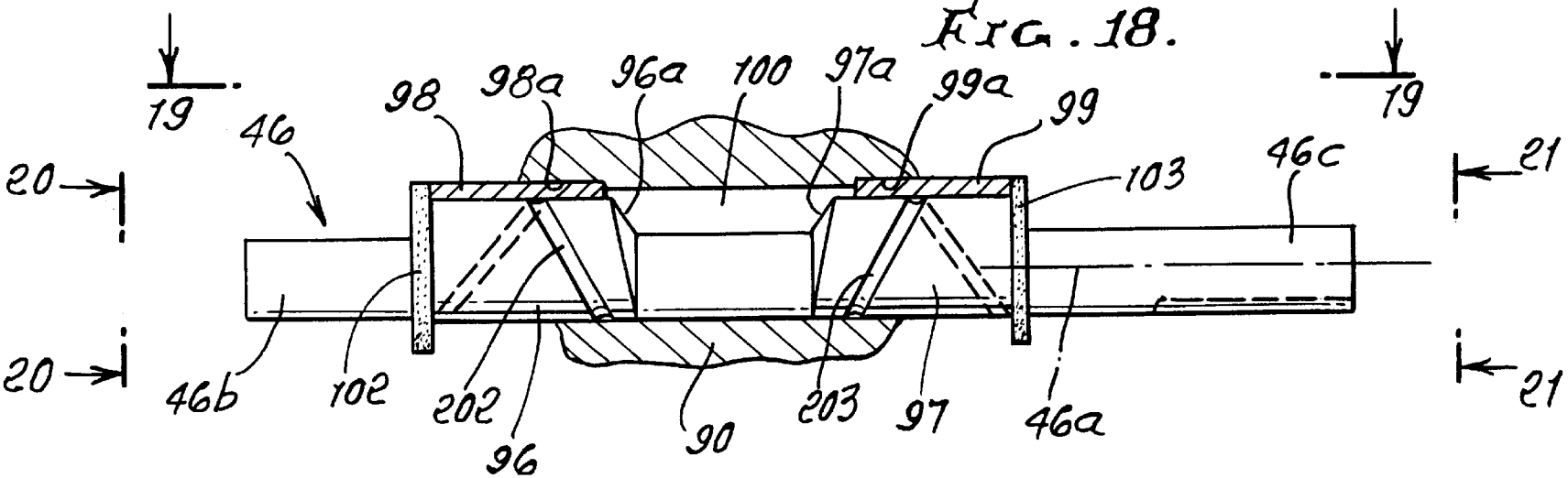
Figure 19:
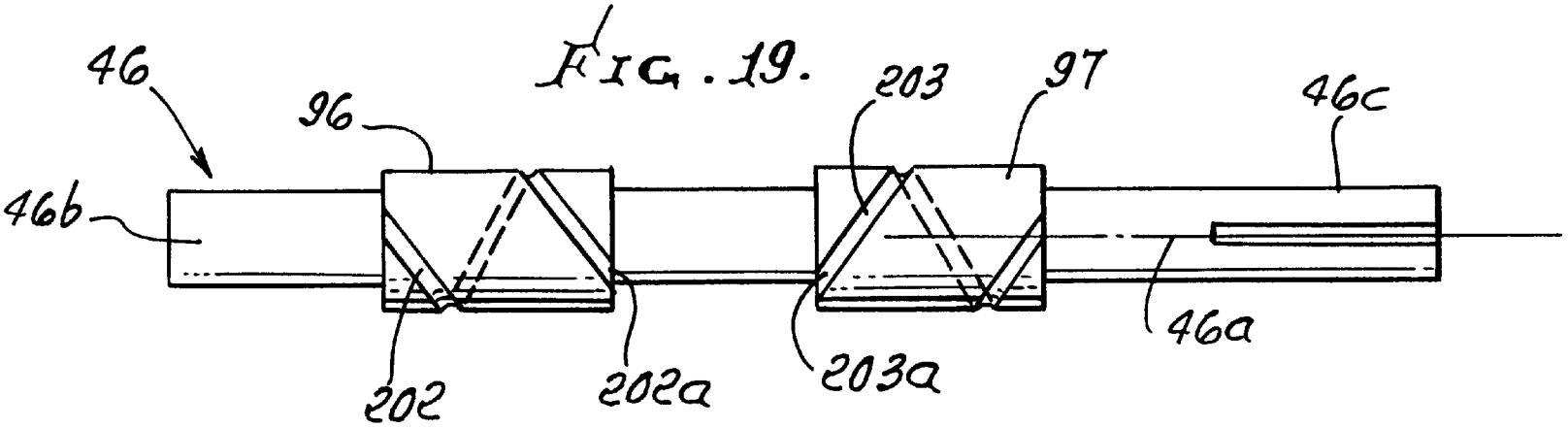
Figure 20:
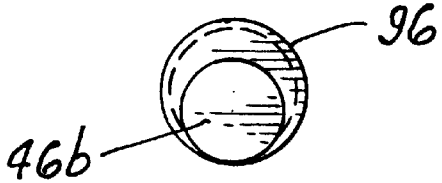

FIGS. 14 and 15 are sections on lines 14—14 and 15—15 of FIG. 13;

FIG. 16 is a section on lines 16—16 of FIG. 15;

FIG. 17 is an enlarged view of shaft eccentrics at opposite ends of a lubricant receiving space;

FIG. 18 is an elevation taken on lines 18—18 of FIG. 17;

FIG. 19 is a top plan view taken on lines 19—19 of FIG. 18;

FIG. 20 is an end view taken on lines 20—20 of FIG. 18; and

Figure 21:
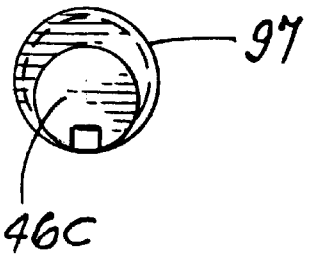

FIG. 21 is an end view taken on lines 21—21 of FIG. 18.

Figure 22:
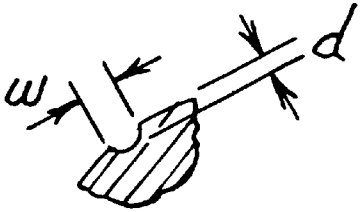

FIG. 22 is a section taken on lines 22—22 of FIG. 17, to show groove configuration.

DETAILED DESCRIPTION

Figure 1:
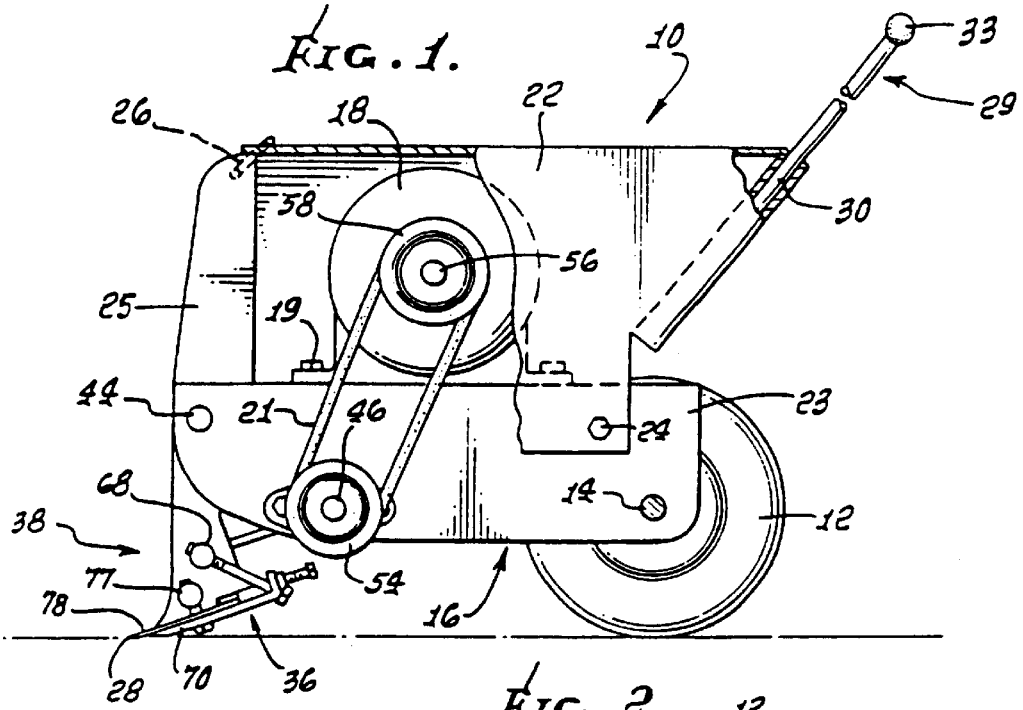
FIG. 1 is a side elevation showing a floor stripping machine incorporating the invention.
Figure 2:
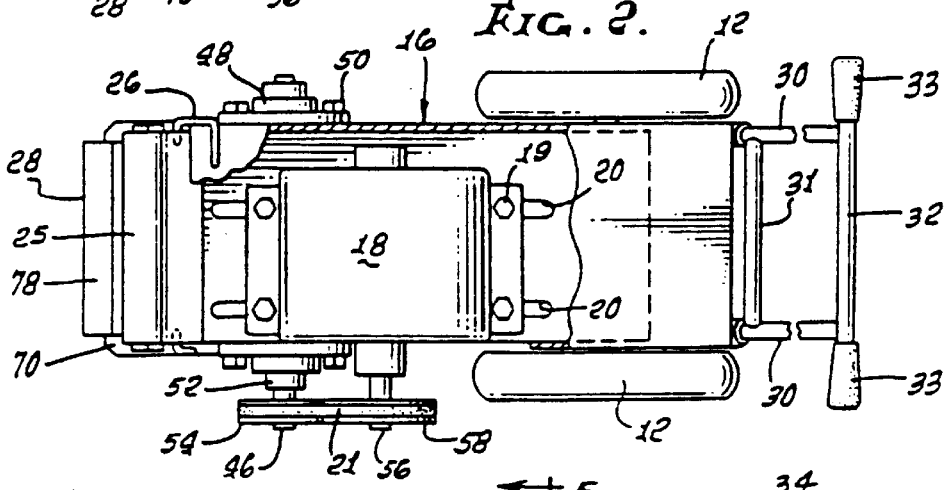
FIG. 2 is a top plan view of the FIG. 1 machine.

Referring now to the drawings and initially, to FIGS. 1 and 2, inclusive, for this purpose, it will be seen that one type of machine in which the invention may be incorporated has been designated in its entirety by reference number 10. Mounted on the machine 10 are a pair of rubber tires 12 which permit the machine 10 to be easily transported and maneuvered. The wheels 12 are carried by an axle 14 which in turn passes through the rear portions of the base frame 16. Mounted on the frame 16 is an electrical motor 18. The machine 10 may alternately be powered by an internal combustion engine. The motor 18 is held in place by four mounting bolts 19 which pass through slots 20 in the frame 16. When the bolts 19 are loosened the motor can be moved forward or backward on the frame 16 by reason of the slots 20 to adjust the tension in the drive belt 21. Covering the motor 18 and attached to the frame 16 is a cover shroud 22. The shroud 22 slides over the side walls 23 of the frame and is held in place by bolts 24 as can be seen in FIG. 1. Positioned on the front of the frame 16 is a nose weight 25. The weight is held in place by means of a releasable wire clip 26 which fastens the forward edge of the shroud 22 with the weight 25. The weight provides the necessary weight on the cutting edge 28 which will later be described.

The handle bar 29 comprises a pair of elongated tubular members 30 which are attached at their lower ends to the shroud 22, and at their upper ends are joined by tubular cross members 31 and 32. Hand grips 33 are used to handle and maneuver the machine 10.

Figure 3:
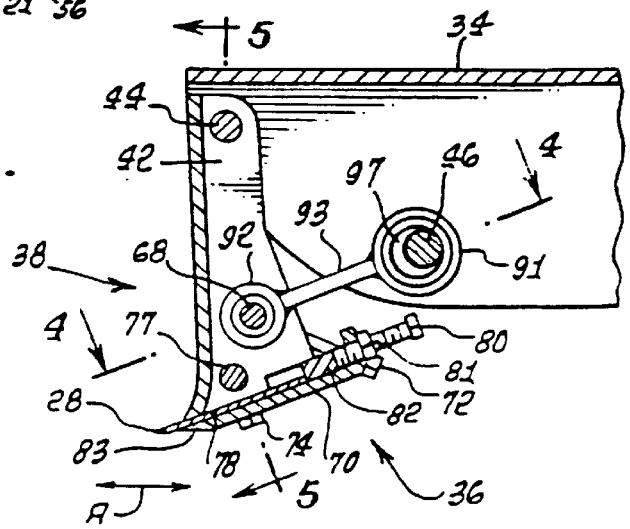
FIG. 3 is an enlarged elevation taken on lines 3—3 of FIG. 4.
Figure 4:
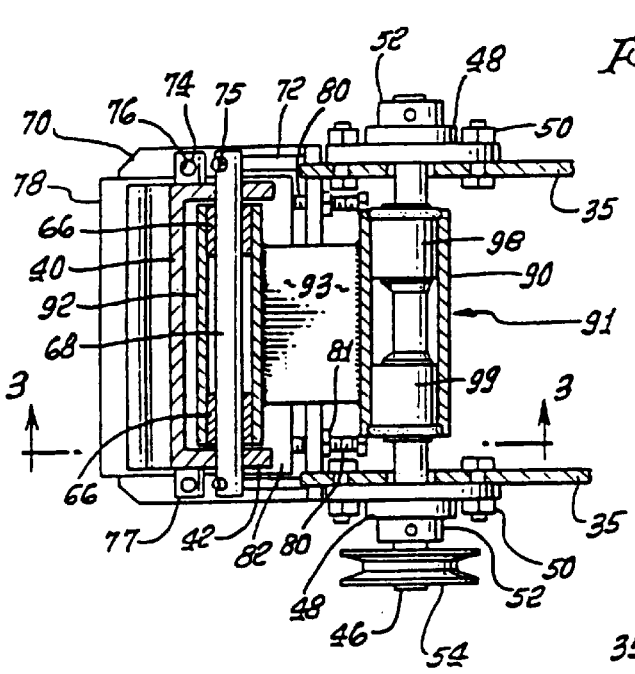
FIG. 4 is a section taken on lines 4—4 of FIG. 3.
Figure 5:
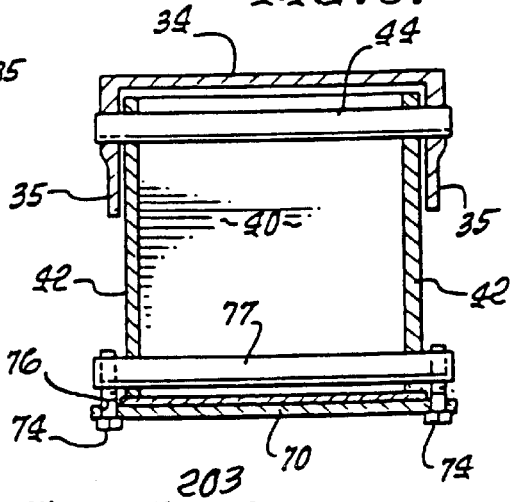
FIG. 5 is a section taken on lines 5—5 of FIG. 3.
Figure 6:
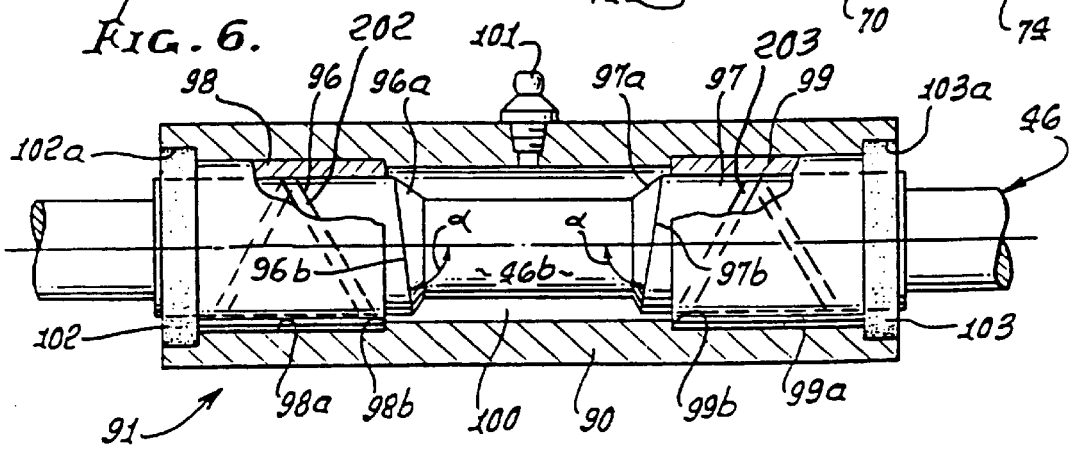
FIG. 6 is an enlarged section taken through connecting structure seen in FIG. 4.

FIGS. 3 through 5 show the cutter head subassembly 36 in detail. The frame 16 previously mentioned is substantially U-shaped with a horizontal web portion 34 and a pair of vertical flanges 35 as can best be seen in FIG. 5. At the forward end of the frame 16 positioned between the flanges 35 is the cutting head 38. The head 38 is formed with a web 40 and a pair of flanges 42. The cutting head is pivotally mounted at the upper end to the frame 16 by a pin 44 which passes through both pairs of flanges 35 and 42. Passing through the pair of flanges 35 and journalled thereto is a rotatably mounted drive shaft 46 which is shown in FIGS. 4 and 6. The shaft 46 is journalled at its outer ends in a pair of roller bearings 48 which are in turn bolted to the frame flanges 35 by means of bolts 50. Retaining the cam shaft in the bearings 48 are pair of locking sleeves 52 which are mounted on the shaft 46 immediately outward of the bearings 48. Keyed to one end of the shaft 46 is a sheave 54 adapted to carry a V-belt. Mounted on the shaft 56 of the motor 18 is a similar sheave 58 which lies in the same plane of rotation as sheave 54. The two sheaves 54 and 58 are connected by means of a rubber V-belt 21. The tension in the V-belt 21 may be adjusted as previously discussed.

Figure 7:
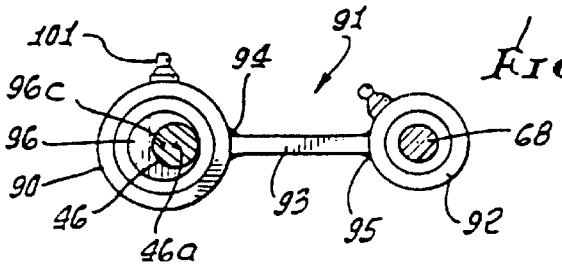
FIG. 7 is an end elevation view of the FIG. 6 connecting structure.

The shaft 46 extends within a first tubular part 90 of a connecting element 91, the latter also incorporating a second and smaller diameter tubular part 92. Those tubular parts comprise steel interconnected by a steel plate 93 welded to outer side portions of the sections, as at 94 and 95. See FIG. 7.

Shaft 46 carries two axially spaced eccentrics 96 and 97. See in FIG. 7 the axis 96*c* of eccentric 96 offset from the axis 46*a* of shaft 46. Each eccentric is cylindrical to rotate within a bearing, such as a bushing, the two bushings indicated at 98 and 99 and received in counterbores 98*a* and 99*a* in the pipe section, and against step shoulders 98*b* and 99*b*. The large space 100 thus provided between the eccentrics provides a lubricant (grease) reservoir, for long lasting lubrication of the two bearings, as the shaft rotates and as the eccentrics oscillate the part 90, and the element 91 back and forth, as will be described. Shaft section 46*b* extends between and interconnects the two eccentrics.

Note that the eccentrics have oppositely facing end portions or faces 96*a* and 97*a*, which, due to their flaring eccentricity, tend to positively displace the grease as the eccentrics rotate. This serves to urge grease radially outwardly, and to feed toward the bushings and the bearing surfaces of the eccentrics and bushings, for enhancement of lubrication as will be referred to. Note that faces 96*a* and 97*a* intersect the outer surfaces of the eccentrics in planes 96*b* and 97*b* that are at angles $\alpha$ relative to the shaft axis, angles $\alpha$ being less than 90°. Grease is introduced to space 100 via a grease fitting 101 in part 90, as shown.

Annular elastomeric seals 102 and 103 are located at opposite ends of the bushings, and pressed into the shaft counterbores 102*a* and 103*a*, as shown. Those seals exert pressure on the shaft eccentrics to prevent escape of grease.

At the opposite end of element 91 is a bearing shaft 68 journaled via bushings 66 to the pipe section 92. Shaft 68 is in turn mounted to cutting head 38. When shaft 56 is rotated, element 91 is oscillated back and forth to cause head 38 to move back and forth about the axis of pipe 44, as indicated by arrows in FIG. 3.

At the lower extremities of the cutting head 38 the flanges 42 become wider to accommodate the cutting blade shoe 70. The shoe 70 is adjustably held against the cutting head by two pairs of bolts 72 and 74. The bolts 72 pass through openings 75 in the rear of the blade shoe 70 and are threaded into 42 as seen in FIG. 3. The bolts 74 pass through openings 76 and are threaded into the ends of shaft 77. The purpose of the blade shoe 70 is to rigidly hold the cutting blade 78 in its cutting position. Located on the back edge of the blade shoe 70 are a pair of adjusting bolts 80 and locking nuts 81 which allow for adjustment of the position of the blade stop 82 which in turn adjusts the amount of blade edge exposure. The front edge 83 of the blade shoe 70 is tapered to provide a maximum amount of rigidity to the cutting blade and yet permit a shallow angle of slope between the cutting blade 78 and the flooring surface being stripped.

Figure 8:
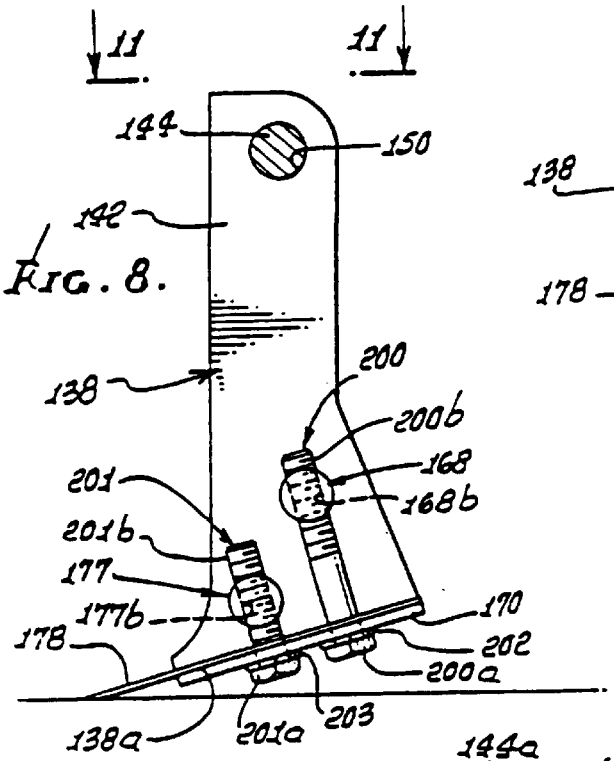
FIG. 8 is a side elevation.
Figure 10:
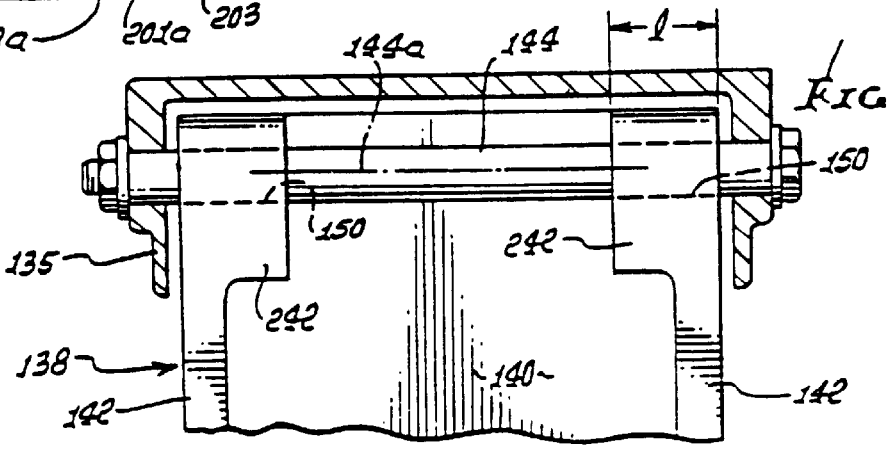
FIG. 10 is a fragmentary front elevation, showing the head of FIG. 8.
Figure 11:
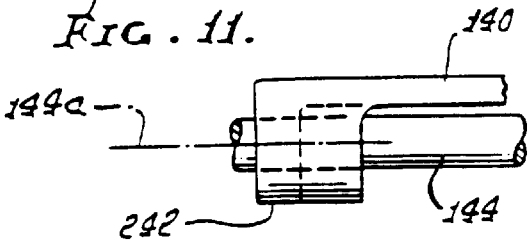
FIG. 11 is a fragmentary plan view on lines 11—11 of FIG. 8.

FIGS. 8, 10 and 11 show a modified head 138 consisting of lightweight metal such as aluminum, or aluminum alloys, or magnesium, or magnesium alloys. The head has two elongated flanges 142 interconnected by a web 140. The flanges are locally thickened near upper ends of the flanges to define two widened lugs 242 that form widened bearings openings 150 for a pivot shaft 144. The latter is connected to the frame flanges 135 (corresponding to flanges 35 in FIG. 5). The bearing openings (and the lugs) have lengths "l" in access of ¾ inch, and preferably are between ¾ an 1½ inches in length. As a result, destructive wear of the head metal surrounding the openings 150 is eliminated, and in particular or heavy duty operation where stripping forces are extensive.

Figure 11A:
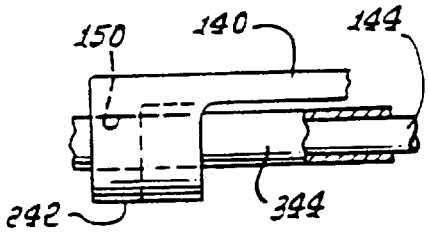
FIG. 11*a* is a view like FIG. 11.

The openings are sized to closely receive the pivot shaft 144, and define a common axis 144*a*. FIG. 11*a* shows modification, with a steel tube 344 received in openings 150, and in turn receiving the shaft 144. Tube 344 helps distribute loading to insure against destructive wear of the lightweight metal lugs 242.

Figure 9:
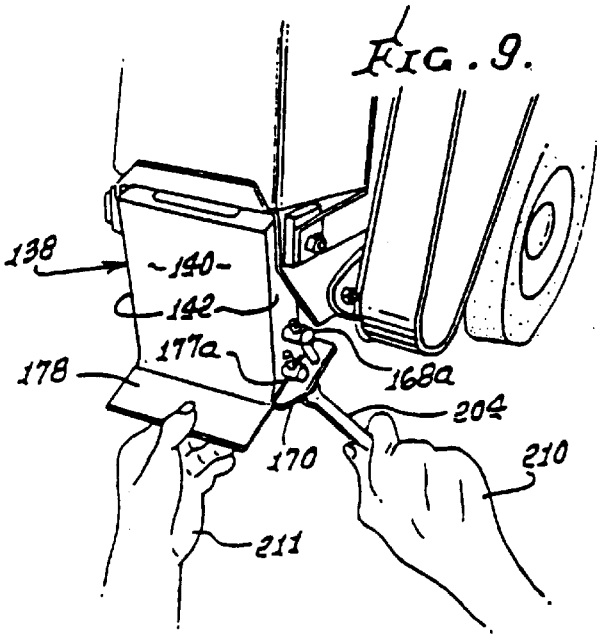
FIG. 9 is a perspective view.

FIGS. 8 and 9 also show the use of the modified blade holder plate 170 attached to the head 138 at its bottom side 138*a*. Blade 178 is clamped against that side, by the plate. Two shafts, 177 and 168 extend parallel to the web 140 and through flanges 142 to provide shaft projections 177*a* and 168*a* at the exterior side of each flange. Two pairs of fasteners 200 and 201 extend in parallel relation through suitable openings in the holder plate and in the blade, at opposite ends of the shafts, respectively. The fasteners have heads 200*a* and 201*a* that clamp split washers 202 and 203 against the bottom of the holder plate. Also, the fasteners have threaded shanks 200*b* and 201*b* received in threaded engagement with threaded openings 177*b* and 168*b* in the shaft projections 177*a* and 168*a*. Accordingly, tightening of the blade in position as shown in FIG. 9 may be accomplished using one hand 210 only, i.e. by manipulation of the wrench 204 in grip engagement with the fastener heads, and the blade may be held and positioned by the other hand 211.

The operation of the stripping machine 10 varies with the type of floor being removed. The steeper the angle of the blade 78 with the floor the deeper the blade will dig. The angle can be varied by lifting the wheels 12 off the floor. The angle can also be varied by extending the blade 78 further past the edge of the shoe 70. When removing a plywood or particle board floor an extra long blade which extends an additional four inches or more past the edge of the shoe 70 has proven very useful. The longer the blade 78 is extended out of the shoe the less the angle between the cutting blade and floor. The amount of Weight applied to the cutting edge 28 is also variable depending upon the flooring being removed. The weight can be varied by the amount of pressure applied by the hands to the handle bar 29. Generally, the machine best operates when the handle bar 29 is lifted up until the wheels are one-half-inch off the floor. When an exceptionally tough flooring is being removed, a blade with teeth formed on the cutting edge has been found to be very effective.

Figure 12:
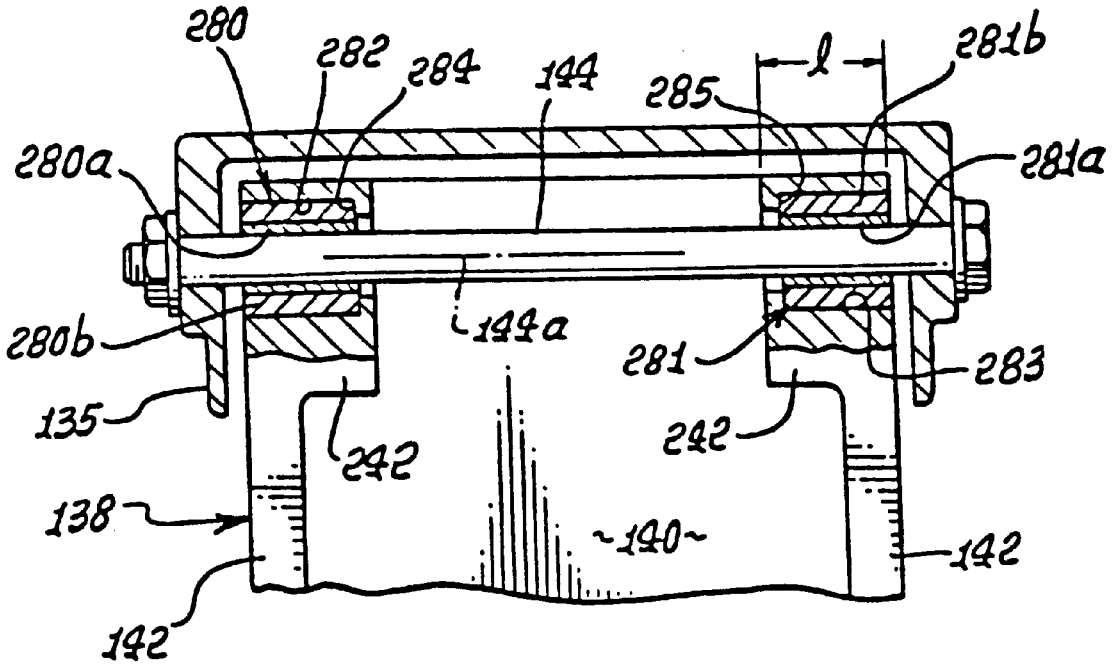
FIG. 12 is a view like FIG. 10, but showing a modification.

FIG. 12 is a view like FIG. 10, with corresponding elements having the same identifying numbers. It differs from FIG. 10 in the provision of bushings 280 and 281 fitted and retained in bores 282 and 283 in lugs 242. The bushings may endwise fit against stop shoulders 284 and 285 in the lugs. The bushings may advantageously be self-lubricated, as provided by annular material 280*a* and 281*a* carried in metallic (as for example bronze) sleeves 280*b* and 281*b* press-fitted in bores 282 and 283. Material 280*a* and 281*a* may for example consist of molybdenum disulfide. One example of such bushings are known "OILITE" bushings.

Pivot shaft 144 (typically steel) is received in, and has low friction running fit in, the bores of the annuli 280*a* and 281*a*, for long lasting, low wear operation.

FIGS. 13–16 show an improved form of the head 338 and connector 391. (Elements corresponding to those of FIGS. 1–11 have the same numbers, with "3" preceding each number).

Connector 391 is a casting made of lightweight metal such as zinc or aluminum, and has first and second tubular parts 390 and 392, the outer diameter of part 390 for example being about 1⅝ inches, and that of part 392 being about 1¼ inches. Self lubricated bushings or bearings 398 and 399 are press fitted into bores 398*a* and 399*a* of part 390. Shaft 346 is as described before, and as shown in FIG. 6, where it bears number 46.

The connector 391 also includes two legs 400 and 401 which extend substantially parallel between tubular parts 390 and 392 and merge therewith, at the opposite ends of the legs, at locations spaced from the opposite ends of the tubular parts 390 and 392. The legs have first webs 401*a* and 401*b* which define planes 402 normal to parallel axis 403 and 404 defined by parts 390 and 392. Those planes also intersect the enlarged, heavy duty lugs 442 integral with head 338, for maximum strength.

The legs also have second webs 401*c* and 401*d* defining planes 405 normal to planes 402, and parallel to spaced parallel axis 403 and 404. Second webs 401*c* and 401*d* merge with the tubular parts or elements 390 and 392 along the sides thereof facing one another, as shown. Webs 401*a* and 401*b* intersect webs 401*c* and 401*d* at mid-region 406 (see FIG. 16), and all four webs taper outwardly, away from that region, as shown to form a cross. Accordingly, a high strength, low weight, connection of parts 390 and 391 is formed, utilizing a light-weight, unitary metal casting. Mid-region 406 is enlarged, for added strength, and webs 401*a*–401*d* maximally resist relative bending of parts 390 and 392.

The flanges 342 have widths "w" that increase in dimension in direction toward the plate 370 and blade 378, as shown in FIG. 15, and the tubular part 392 is confined between those flanges, with the webs 401*a*–401*d* merging with part 392 between the flanges of increased width near plate 370.

Self-lubricated bushings are employed at 380 and 381, in the two lugs 342, to receive tubular shaft 344. "OILITE" bushings may be used for this purpose.

The head 338 may also consist of the same lightweight metal as connector 390, whereby a very lightweight assembly is provided for minimum vibration transmission to the user.

Referring to FIGS. 17–22, they show preferred forms of the shaft 46 and eccentrics 96 and 97 in greater detail. Grooves are sunk in the outer surfaces 200 and 201 of the eccentrics, the grooves indicated at 202 and 203. Each groove spirals along and about the length of the eccentric, and typically about 360° around and along the eccentric body. The grooves have grease entrance ends 202*a* and 203*a* at axially spaced locations closest to the center of 100, in communication with outer portions of the lubricant receiving space 100, at its opposite ends. Each groove typically extends from its entrance end at one end wall of the eccentric to the opposite end at the opposite end wall of the eccentric. A single spiral, or about such a single spiral, from end to end of the eccentric maximizes grease exposure to different areas of the bearings, while minimizing groove length.

Grease is urged, under centrifugal pressure, into and along the spiral length of the groove, for distribution to the bearing cylindrical surfaces that extend about the outer surfaces of the two eccentrics, for assured optimum lubrication. Each groove typically has width "w" which is about 0.125 inch, and depth "d", which is about 0.015, as indicated in FIG. 22. Seals 102 and 103 at the ends of the eccentric block leakage of grease from the lubricated spaces between the eccentrics and bearing bushings, to which lubricant such as grease is pressure fed via the spiraling grooves. The eccentric shaft end portions are indicated at 46*b*–46*c*.

The spiraling grooving extends eccentrically relative to the shaft axis of rotation; and rotation of the grooving about the shaft axis effects pulsing centrifugal force application to the eccentrically rotating lubricant in the groove and outward vibration or pulsing of the lubricant in the grooving toward the surrounding surface of the bearing, enhancing the lubrication distribution effect and effectiveness.

As shown in FIG. 13, the two planes 402, as referred to above, also intersect the two eccentrics 96 and 97, the lubricant receiving space being centered between the eccentric oppositely facing flaring ends.

I claim:

1. A power-operated floor stripping apparatus comprising a frame, a drive carried on the frame, wheels supporting the frame, a handle to guide the frame, a cutting blade carried by a head which is pivotally mounted to the frame, the combination comprising a) a connecting element having a first tubular part and a second tubular part, said first and second parts having spaced parallel axes, one tubular part having an outside diameter substantially larger than the outside diameter of the other tubular part, b) a drive shaft extending within said first tubular part, said drive shaft operatively connectible to the drive to be rotated thereby, said drive shaft defining an axis, c) said drive shaft carrying two axially spaced substantially cylindrical eccentrics to be rotated by the drive shaft, there being a lubricant receiving space located directly between said eccentrics, said eccentrics having flared end faces at opposite ends of said space, d) two annular bearings respectively carried by and within said first tubular part, said annular bearings respectively receiving said spaced eccentrics to oscillate said first tubular part, said head and said blade as said eccentrics are rotated by the shaft, e) said head consisting of lightweight metal and having two flanges interconnecting by a web, the flanges being locally thickened to substantial extent to define two lugs, f) said second tubular part extending between said flanges and pivotally connected to said flanges in spaced relation to said lugs, g) said connecting element including two substantially parallel legs extending between said first and second tubular parts and integrally merging therewith at locations spaced from the ends of said first and second tubular parts, the improvement comprising h) there being spiral grooves sunk in the external surfaces of said eccentrics to communicate with said lubricant receiving space to receive lubricant for distribution along said eccentrics to the annular bearings, said spiral grooves extending eccentrically relative to said shaft axis, said annular bearings having bearing surfaces exposed to and facing said grooves, i) said grooves having lubricant entrance ends located at flared end faces of the eccentrics, and communicating with outer portions of said lubricant receiving space, said flared end faces flaring away from said entrance ends and from one side of the eccentric toward its opposite side, j) each groove spiraling about 360° between its entrance end and the end of the eccentric remote from said lubricant receiving space, k) the spiral grooves having ends in communication with outer portions of said lubricant receiving space, l) said eccentrics end faces being oppositely facing and flaring radially outwardly and axially away from said lubricant receiving space, to urge and guide lubricant toward said annular bearings, said grooves intersecting said flared end faces, at locations in axial radial planes which are closest to the center of said lubricant receiving space, m) said eccentrics having outer cylindrical surfaces and said end faces intersecting said outer cylindrical surfaces of the eccentrics in planes extending at angles $\alpha$ relative to the drive shaft axis, said angles $\alpha$ being less than 90°, said grooves having axially spaced entrance ends on said flared end faces closest to the center of said lubricant receiving space, n) and wherein said groove entrance ends are located at opposite ends of said lubricant receiving space, at minimum flared locations at said flared ends of said eccentrics.

2. The improvement of claim 1 wherein each groove has about 1.25 inch width, and about 0.015 inch depth, along the groove length.

3. The combination of claim 1 wherein:

j) said substantially parallel legs have first webs defining first planes normal to said parallel axes defined by said first and second parts, k) second webs normal to said first webs, and defining second planes parallel to said spaced parallel axes defined by said parts, said second webs also merging with said first and second parts, said first and second webs extending in intersecting relation to an enlarged central region of each leg, l) said first planes defined by the first webs also intersecting said eccentrics and said lubricant receiving space being centered between said eccentric oppositely facing flaring ends.

4. The combination of claim 3 wherein said first planes defined by the first webs intersect said lugs proximate inner edges defined by the lugs.

5. The combination of claim 1 including bearing bushings received in and carried by said lugs to form bearing openings for a pivot shaft connected to the frame, said bushings being self-lubricated adjacent the pivot shaft.

6. The combination of claim 1 including a blade holder plate attached to the head at the bottom side thereof, said flanges each having width that increases in direction toward said blade holder plate, two shafts extending parallel to said head web and through said head flanges to provide shaft projections exteriorly of said flanges, and fasteners extending through said blade holder plate and having threaded shanks in threaded engagement with threaded openings in said shaft projections, the fasteners having heads below said blade holder plate to be rotated for clamping the blade between the blade holder plate and the head bottom side, said substantially parallel legs merging with said second tubular part at locations proximate the increasing width of said flanges.

7. The combination of claim 1 wherein said first and second tubular parts and said substantially parallel legs are defined by a lightweight metal casting.

8. The combination of claim 7 wherein said metal casting consists of metal selected from the group consisting essentially of zinc, and aluminum.

9. The combination of claim 1 wherein said bearings comprise bushings.

10. A floor stripping apparatus comprising a connecting element, a floor stripping blade, a head, a drive, the apparatus further comprising:

a) said connecting element having a first tubular part and a second tubular part, said first and second tubular parts having spaced, parallel axes, b) a drive shaft extending within said first tubular part, said drive shaft operatively connectible to the drive to be rotated thereby, c) said drive shaft carrying two axially spaced substantially cylindrical eccentrics to be rotated by the drive shaft, there being a lubricant receiving space located directly between said eccentrics, said drive shaft defining and axis, said eccentrics having flared end faces at opposite ends of said space, d) two annular bearings respectively carried by and within said first tubular part, said annular bearings respectively receiving said spaced eccentrics to oscillate said first tubular part, said head and said blade as said eccentrics are rotated by said drive shaft, e) there being spiral grooves sunk in the external surfaces of said eccentrics to communicate with said lubricant receiving space to receive lubricant for distribution along said eccentrics to said annular bearings, said spiral grooves extending eccentrically relative to said shaft axis, said annular bearings having bearing surfaces exposed to and facing said grooves, f) said grooves having lubricant entrance ends located at outer portions of said lubricant receiving space, and there being flared end faces of the eccentrics flaring away from said entrance ends and from one side of the eccentric toward its opposite side, said entrance ends also intersecting said flared end faces, g) each groove spiraling about 360° between its entrance end and the end of the eccentric remote from said lubricant receiving space.

11. The apparatus of claim 10 wherein said spiral grooves have ends in direct communication with outer portions of said lubricant receiving space.

12. The apparatus of claim 10 wherein each groove has about 0.125 inch width, and about 0.015 inch depth, along the groove length.

13. The method of operating floor stripping apparatus having a connecting element, a floor stripping blade, a head, and a drive, and wherein the apparatus comprises:

a) said connecting element having a first tubular part and a second tubular part, said first and second tubular parts having spaced, parallel axes, b) a drive shaft extending within said first tubular part, said shaft operatively connectible to the drive to be rotated thereby, c) said drive shaft having two axially spaced substantially cylindrical eccentrics to be rotated by the drive shaft, there being a lubricant receiving space located directly between said eccentrics, said eccentrics having flared end faces at opposite ends of said space, d) two annular bearings respectively carried by and within said first tubular part, said annular bearings respectively receiving said spaced eccentrics to oscillate said first tubular part, said head and said blade as said eccentrics are rotated by the drive shaft, e) spiral grooves sunk in the external surfaces of said eccentrics to communicate with said lubricant receiving space to receive lubricant for distribution along said eccentrics to said annular bearings, f) said spiral grooves each extending eccentrically relative to said shaft axis, said annular bearings having bearing surfaces exposed to and facing said grooves, g) said grooves having lubricant entrance ends located at outer portions of said lubricant receiving space, each groove spiraling about 360° between its entrance end and the end of the eccentric remote from said lubricant receiving space, the eccentrics having flared end faces flaring away from said groove entrance ends and from one side of the eccentric toward its opposite side, the entrance ends also intersecting said flared end faces, h) said method including rotating said grooves eccentrically, by rotating said drive shaft and said eccentrics, to rotate and vibrate lubricant adjacent said flared ends and into said grooves, driving said lubricant toward inner surfaces defined by said annular bearings.

* * * * *